US007607182B1

(12) United States Patent
Weiner

(10) Patent No.: US 7,607,182 B1
(45) Date of Patent: Oct. 27, 2009

(54) BEACH BLANKET ASSEMBLY

(76) Inventor: Mitch Weiner, 343 Palos Verdes, #3, Redondo Beach, CA (US) 90277

( * ) Notice: Subject to any disclaimer, the term of this patent is extended or adjusted under 35 U.S.C. 154(b) by 0 days.

(21) Appl. No.: 12/218,095

(22) Filed: Jul. 10, 2008

(51) Int. Cl.
*A47G 9/06* (2006.01)

(52) U.S. Cl. ..... 5/418; 5/114; 5/110

(58) Field of Classification Search ..... 5/417–418, 5/110–114, 201
See application file for complete search history.

(56) References Cited

U.S. PATENT DOCUMENTS

| | | | | |
|---|---|---|---|---|
| 2,670,478 | A * | 3/1954 | Gilfillan | 5/114 |
| 3,935,653 | A | 2/1976 | Klein | |
| 4,278,719 | A | 7/1981 | Sarnecki | |
| 5,018,230 | A | 5/1991 | Steberger | |
| 5,299,331 | A * | 4/1994 | Badillo | 5/417 |
| 5,394,575 | A | 3/1995 | Wolter | |
| 5,406,659 | A | 4/1995 | Camp | |
| 5,435,025 | A | 7/1995 | Gerard | |
| 6,061,849 | A | 5/2000 | Seals | |
| 6,185,765 | B1 | 2/2001 | High | |
| 6,192,536 | B1 | 2/2001 | Conners | |
| 6,463,605 | B2 | 10/2002 | Swagger, Jr. | |
| 6,502,257 | B1 | 1/2003 | Glenn | |

OTHER PUBLICATIONS

Product Advertisements found on the Internet. 7 Pages.

* cited by examiner

*Primary Examiner*—Fredrick Conley
(74) *Attorney, Agent, or Firm*—Dennis W. Beech

(57) ABSTRACT

The present invention may be used as a beach blanket. A blanket may be generally rectangular in shape with a tab attached at each corner. There may also be an interior tab attached on a bottom surface approximately on a corner diagonal axis adjacent each of the tabs. A frame may be generally an open rectangular shape with two opposed spaced apart longitudinal tubular members attached to two opposed and spaced apart lateral tubular members by four corner members. The corner members may have two orthogonal horizontal arms and an orthogonal vertical arm wherein each of the vertical arms have a lower attachment element and an upper attachment element for attachment of one of the tabs and one of the interior tabs.

10 Claims, 3 Drawing Sheets

BEACH BLANKET ASSEMBLY

BACKGROUND OF THE INVENTION

This invention relates to devices for beach blankets for deploying on a beach surface and to inhibit the encroachment of sand on the beach blanket. The new beach blanket assembly maintains a beach blanket in an extended condition and includes a barrier to sand encroachment.

The general method of covering an area at a sand beach may be to lay a towel or blanket on the sand. Use of these elements in a beach environment may result in a blanket being moved by wind or other factors and in sand accumulating on a blanket surface. Various devices and assemblies may be known for staking a blanket to a beach surface, using bumper tubular devices that may be air filled or have foam material at the peripheral edge of a blanket, and creating pockets in a blanket for inserting sand to maintain a blanket position on a beach.

Some of these devices and methods may maintain a blanket in position and inhibit the encroachment of sand. However, use of bumpers may create considerable bulk for transport and additional work to deploy a blanket, particularly if stakes may also be involved in deployment. While stakes alone may be known for use with a blanket and one pair of opposed sides may be held in an upturned position by for example clothespins, this may not be a reliable system for prevention of sand encroachment on a blanket.

Use of pockets in blankets may be known for blankets used in a beach environment. These pockets may generally be formed in a blanket such that they would be horizontally positioned when a blanket may be laid on a beach. The pockets may be useable for storage of personal items. It may be advantages to have pockets formed in what become side walls of a blanket when it is deployed on a sandy beach.

SUMMARY OF THE INVENTION

The present invention is directed to devices for use as a beach blanket. A blanket may be generally rectangular in shape with a tab attached at each corner. There may also be an interior tab attached on a bottom surface approximately on a corner diagonal axis adjacent each of the tabs. A frame may be generally an open rectangular shape with two opposed spaced apart longitudinal tubular members attached to two opposed and spaced apart lateral tubular members by four corner members. The corner members may have two orthogonal horizontal arms and an orthogonal vertical arm wherein each of the vertical arms have a lower attachment element and an upper attachment element for attachment of one of the tabs and one of the interior tabs.

These and other features, aspects and advantages of the present invention will become better understood with reference to the following drawings, description and claims.

DETAILED DESCRIPTION

Figure 1:
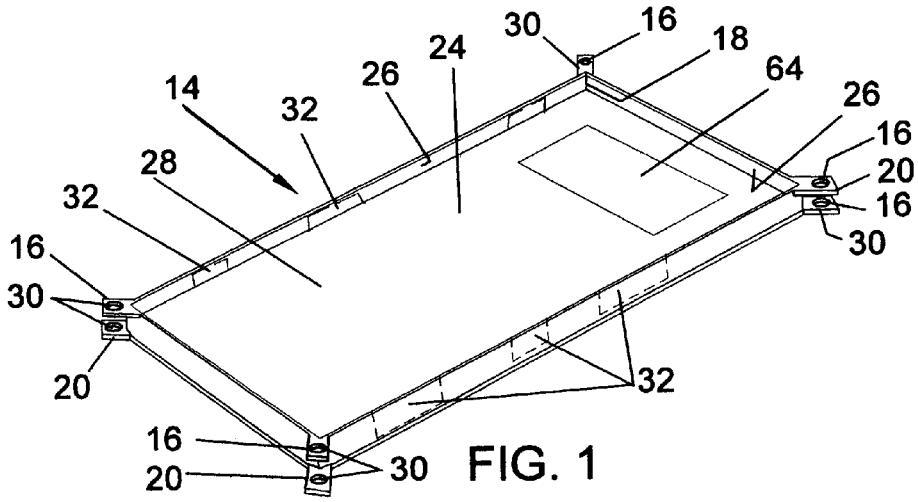
FIG. 1 illustrates a top perspective view of a blanket according to an embodiment of the invention.
Figure 2:
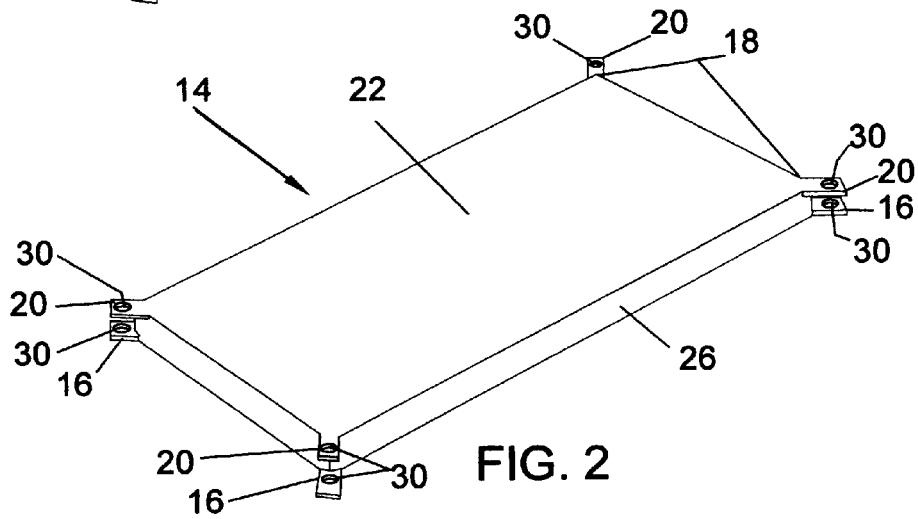
FIG. 2 illustrates a bottom perspective view of a blanket according to an embodiment of the invention.

The following detailed description represents the best currently contemplated modes for carrying out the invention. The description is not to be taken in a limiting sense, but is made merely for the purpose of illustrating the general principles of the invention.

Referring to FIGS. 1 through 4, a beach blanket assembly 10 may have a frame 12 with a blanket 14 positioned thereon. The blanket 14 may be generally rectangular in shape and may be constructed of one or more layers of material suitable for use on a beach. There may be tabs 16 or flaps attached or formed at each of the four peripheral corners 18 of the blanket 14. A second set of four tabs 20 may be attached at the bottom surface 22 of the blanket 14 interior from the tabs 16 approximately along diagonals of opposed corners 18. The positioning of tabs 20 may be determined by the height of a peripheral wall 26 to be formed around the interior portion 28 of the blanket 14 when installed on frame 12. The tabs 16, 20 may have eyelets 30 or grommets for attachment to frame 12. The tabs 16, 20 may be constructed of a stretch material.

Figure 4:
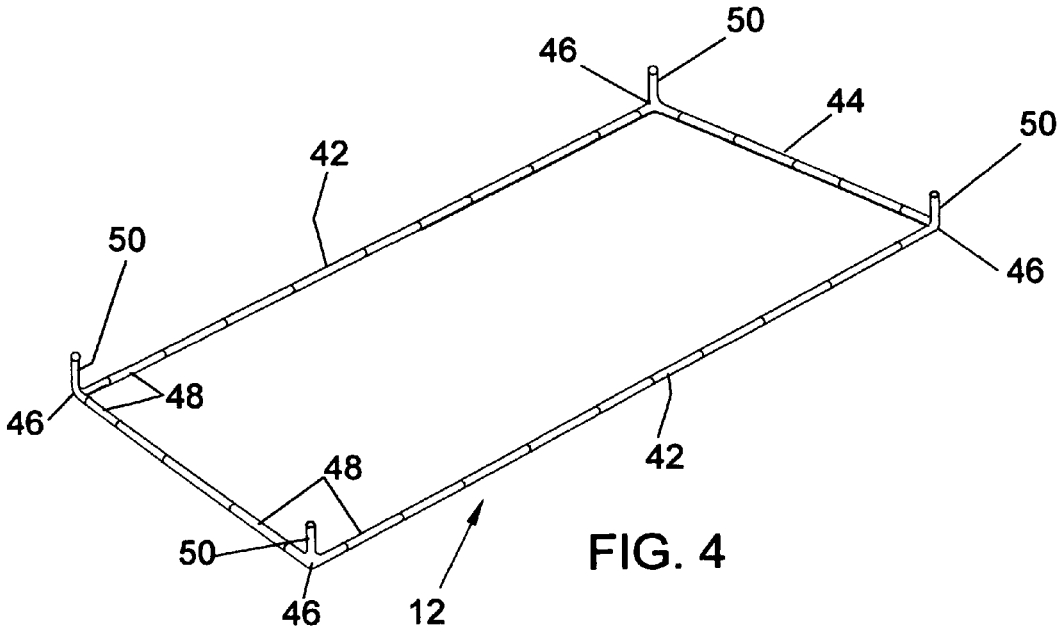
FIG. 4 illustrates a perspective view of a frame according to an embodiment of the invention.
Figure 5:
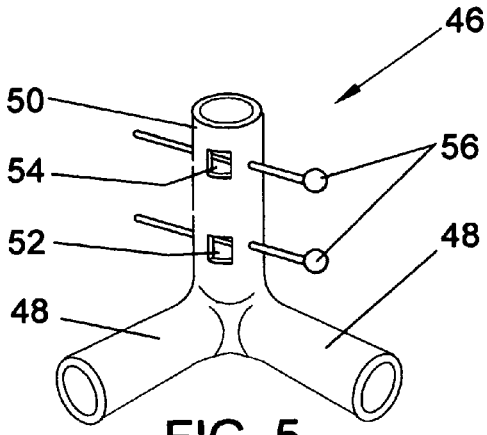
FIG. 5 illustrates a perspective view of a corner element according to an embodiment of the invention.

Referring to FIGS. 4 and 5, the frame 12 may be a structure of opposed, spaced apart tubular members 40 connected to form an open rectangular frame. The longitudinal members 42 and lateral members 44 may be attached by corner members 46. The corner members 46 may have orthogonal arms 48 and 50 structured for receipt of a longitudinal member 42 and a lateral member 44 at arms 48. The arm 50 may be oriented perpendicular to the plane of the tubular rectangular frame portion. The length of the arms 50 may be determined by the height of a peripheral wall 26 to be formed when the blanket 14 may be installed on the frame 12.

Figure 3:
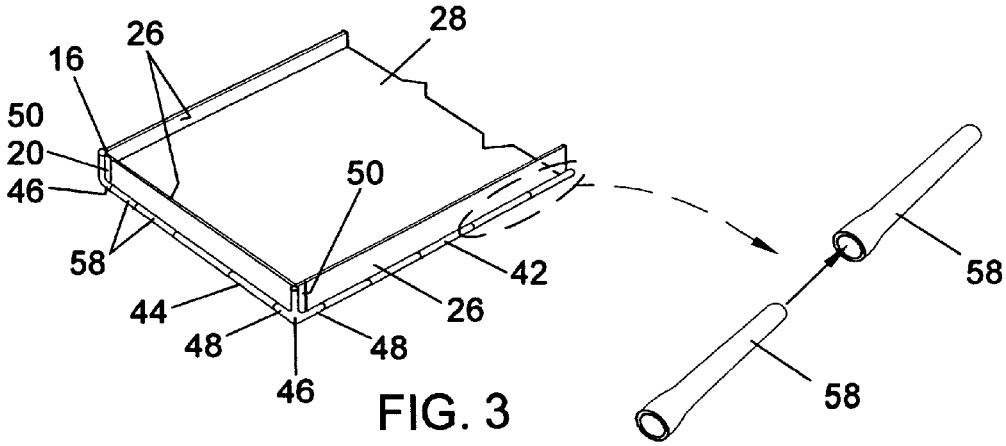
FIG. 3 illustrates a partial perspective view of a blanket assembly according to an embodiment of the invention.

Referring to FIGS. 3 and 5, the blanket 14 may be attached to the frame 12 using tabs 16, 20. The arms 50 of the corner members 46 may have apertures 52, 54 and pins 56 that may be spring biased. The tabs 20 may be inserted in lower apertures 52 and the tabs 16 may be inserted in upper apertures 54. The pins 56 may be inserted in eyelets 30 to retain tabs 16, 20. The wall 26 portion of the blanket 14 may serve as a barrier to inhibit the incursion of sand onto interior portion 28.

Figure 6:
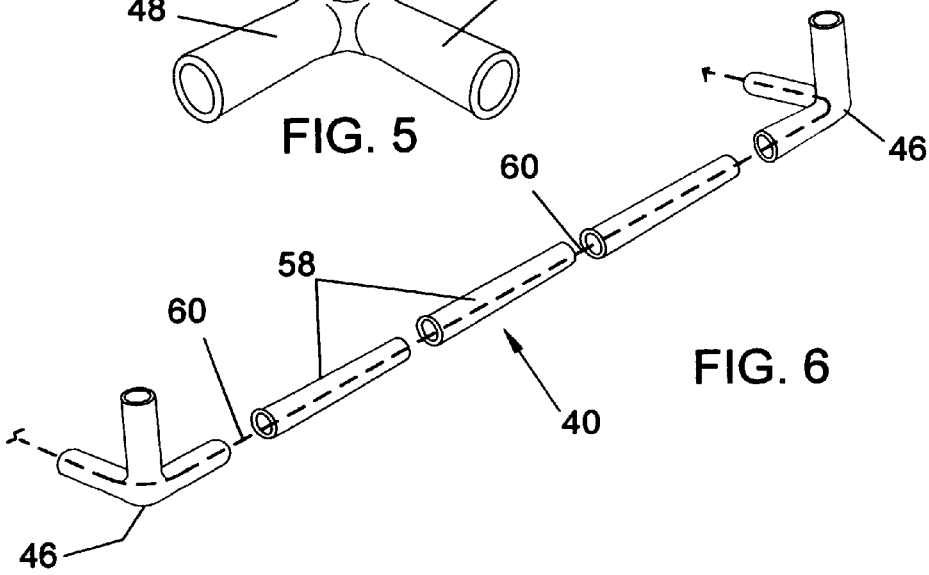
FIG. 6 illustrates a perspective view of a segmented tubular member according to an embodiment of the invention.

Referring to FIG. 6, the tubular members 40 may be segmented 58 to allow disassembly for compact storage and transport. There may be an elastic cord 60 inserted through the segmented tubular members 40 to retain the members in relative position when assembled or disassembled. The tubular members 40 may be circular, rectangular or other appropriate cross-sectional form and may have one end flared or shaped for assembly of the tubular members 40.

Figure 7:
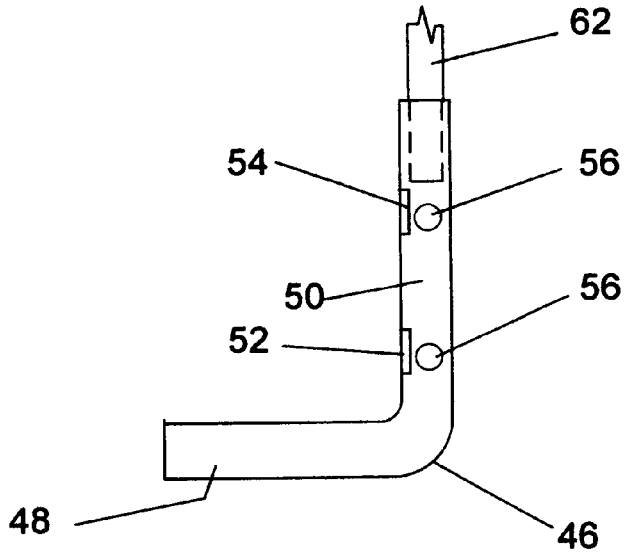
FIG. 7 illustrates an elevation view of a corner element according to an embodiment of the invention.
Figure 8:
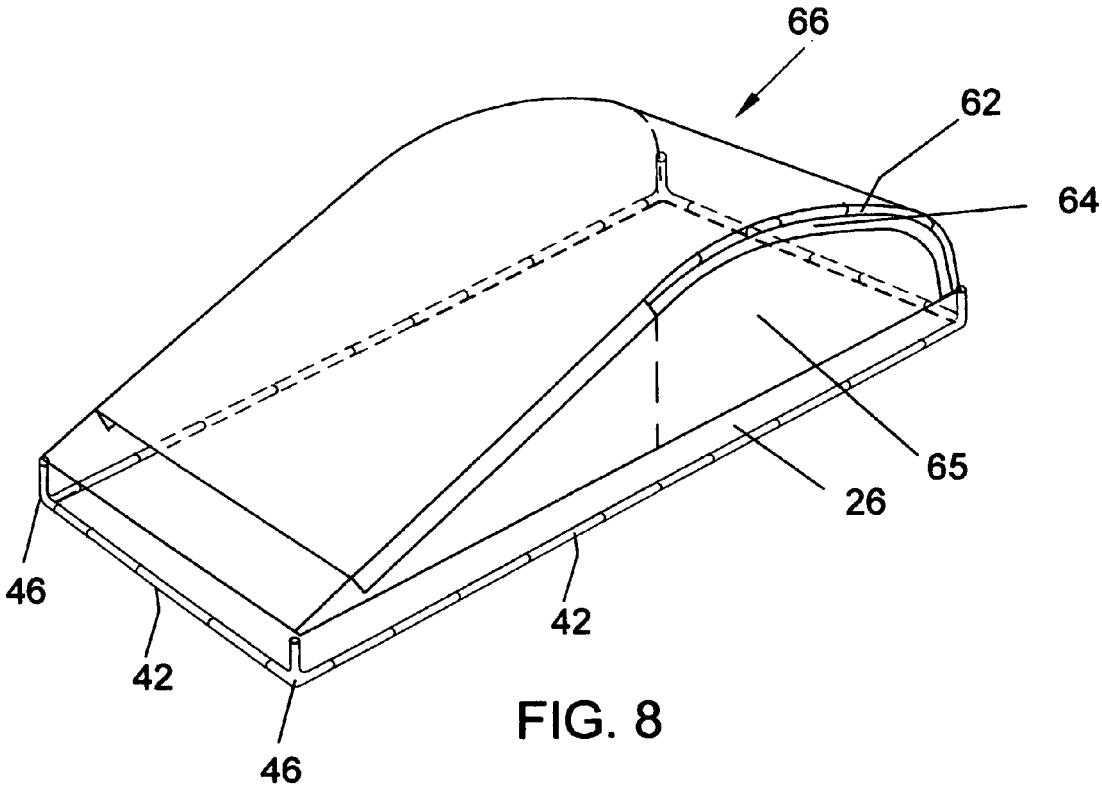
FIG. 8 illustrates a perspective view of a blanket assembly according to an embodiment of the invention.

Referring to FIGS. 7 and 8, the corner members 46 may have arms 50 structured for attachment of flexible tubular members 62. There may be a flexible tubular member 62 attached to two corner members 46 and then bent over to be attached to the two opposed corner members 46. A cover 64 may be attached to the members 62 to form a canopy 66 for shade when using the blanket 14. The cover 64 may also be draped over the line, rope or the like attachment structure to shade or cover a larger portion of the top surface 24. A side portion 65 of the cover 64 may be extended downwardly to for example the dashed line marking on the FIG. 8 to further enclose the blanket assembly 10 or to the end of the cover 64 adjacent the opposed corner members 46. The flexible tubular members 62 may be segmented similarly to the frame 12 tubular members 40.

Referring again to FIG. 1, pockets 32 may be formed in the top surface 24 in the wall 26 portion. The pockets 32 may be generally vertically oriented when the blanket 14 is attached to frame 12. The pockets 32 may be used for storage of personal items and the like.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for use as a beach blanket comprising:

a blanket that is generally rectangular in shape with a tab attached at each corner and an interior tab attached at a bottom surface approximately on a corner diagonal axis adjacent each of said tabs;

a frame that is generally an open rectangular shape with two opposed and spaced apart longitudinal tubular members attached to two opposed and spaced apart lateral tubular members by a plurality of corner members; and said corner members have two orthogonal horizontal arms and an orthogonal vertical arm wherein each of said vertical arms having a lower attachment element and an upper attachment element for attachment of one of said tabs and one of said interior tabs.

2. The device as in claim 1 wherein said tabs and said interior tabs each have an eyelet, and each of said vertical arms having a lower aperture and an upper aperture therein for receipt of said tabs and said interior tabs.

3. The device as in claim 2 wherein a pin is disposed in each of said vertical arms adjacent each of said lower aperture and said upper aperture for insertion in one of said eyelets.

4. The device as in claim 1 wherein said longitudinal tubular members and said lateral tubular members are segmented and an elastic cord is disposed in said longitudinal tubular members, said lateral tubular members and said horizontal arms.

5. The device as in claim 4 wherein said segmented tubular members have a first end flared for receipt of a second end of one of said segmented tubular members.

6. The device as in claim 1 wherein:

a flexible tubular member is attached to said vertical arm of each of two adjacent corner members;

each of said flexible tubular members is bent toward two opposed corner members and attached thereto; and a cover is attached between each of said flexible tubular members.

7. The device as in claim 6 wherein said flexible tubular members are formed of segmented tubular members.

8. The device as in claim 6 wherein said cover has a side wall.

9. The device as in claim 1 wherein a pocket is formed in a top surface adjacent a peripheral edge of said blanket.

10. The device as in claim 1 wherein said tabs and said interior tabs are constructed of an elastic material.

* * * * *